US008294029B2

(12) United States Patent
Tatsumi

(10) Patent No.: US 8,294,029 B2
(45) Date of Patent: Oct. 23, 2012

(54) EXPANDABLE ELECTRIC CORD AND PRODUCTION METHOD THEREOF

(75) Inventor: Shunji Tatsumi, Tokyo (JP)

(73) Assignee: Asahi Kasei Fibers Corporation, Osaka-Shi (JP)

( * ) Notice: Subject to any disclaimer, the term of this patent is extended or adjusted under 35 U.S.C. 154(b) by 457 days.

(21) Appl. No.: 12/521,111

(22) PCT Filed: Dec. 26, 2007

(86) PCT No.: PCT/JP2007/074978

§ 371 (c)(1),
(2), (4) Date: Jun. 24, 2009

(87) PCT Pub. No.: WO2008/078780

PCT Pub. Date: Jul. 3, 2008

(65) Prior Publication Data

US 2010/0006320 A1 Jan. 14, 2010

(30) Foreign Application Priority Data

Dec. 26, 2006 (JP) ..... 2006-348735
Jun. 26, 2007 (JP) ..... 2007-167724

(51) Int. Cl.
*H01B 7/00* (2006.01)

(52) U.S. Cl. ..... 174/110 R; 174/112; 174/113 R; 174/113 AS; 174/113 C

(58) Field of Classification Search ..... 174/110 R, 174/112, 115, 116 R, 113 R, 113 AS, 113 C
See application file for complete search history.

(56) References Cited

U.S. PATENT DOCUMENTS 2,057,272 A * 10/1936 Schumpelt ..... 216/108
3,126,442 A 3/1964 Roberts
3,823,253 A * 7/1974 Walters et al. ..... 174/69
4,683,349 A 7/1987 Takebe
5,552,565 A * 9/1996 Cartier et al. ..... 174/117 F
7,135,227 B2 11/2006 Karayianni et al.
7,504,127 B2 3/2009 Karayianni et al.
7,795,536 B2 * 9/2010 Plourde et al. ..... 174/102 R
2004/0074654 A1 * 4/2004 Springer et al. ..... 174/28
2004/0237494 A1 12/2004 Karayianni et al.
2007/0054037 A1 3/2007 Karayianni et al.
2009/0145533 A1 6/2009 Karayianni et al.

FOREIGN PATENT DOCUMENTS

GB 925083 * 7/1958

(Continued)

OTHER PUBLICATIONS

Supplementary European Search Report dated Sep. 13, 2011.

(Continued)

*Primary Examiner* — William Mayo, III
(74) *Attorney, Agent, or Firm* — Finnegan, Henderson, Farabow, Garrett & Dunner, L.L.P.

(57) ABSTRACT

An expandable electric cord having a core portion, a conductor portion and a sheath portion; wherein the core portion is an elastic cylinder having an elastic body and an intermediate layer covering the outer periphery thereof. The conductor portion contains a conductor wire having narrow stranded wires, with the conductor wire being coiled and/or braided around the outer periphery of the elastic cylinder, and the sheath portion is an outer sheath layer having an insulator that covers the outer periphery of the conductor portion.

10 Claims, 4 Drawing Sheets

FOREIGN PATENT DOCUMENTS

| | | |
|---|---|---|
| GB | 925083 | 5/1963 |
| JP | 58-110909 | 7/1983 |
| JP | 60-119013 | 6/1985 |
| JP | 60-194816 | 12/1985 |
| JP | 61-121207 | 6/1986 |
| JP | 61-124913 | 8/1986 |
| JP | 61-194237 | 8/1986 |
| JP | 61-290603 | 12/1986 |
| JP | 62-186416 | 8/1987 |
| JP | 63-22028 | 2/1988 |
| JP | 2002-313145 | 10/2002 |
| JP | 2003-217359 | 7/2003 |
| JP | 2004-134313 | 4/2004 |
| JP | 3585465 | 8/2004 |
| JP | 2005-347247 | 12/2005 |
| JP | 2006-524758 A | 11/2006 |

OTHER PUBLICATIONS

Office Action dated Sep. 13, 2010 issued in corresponding Chinese application.

Office Action for TW Application No. 096150409 dated Jul. 13, 2012.

* cited by examiner

EXPANDABLE ELECTRIC CORD AND PRODUCTION METHOD THEREOF

This application is a U.S. National Stage of PCT/JP2007/074978 filed Dec. 26, 2007.

TECHNICAL FIELD

The present invention relates to an expandable electric cord useful in various industrial fields including robotics, and more particularly, to an expandable electric cord use for humanoid robots and industrial robots.

BACKGROUND ART

An electric cord typically employs a structure using copper wire for the core, and covering the outer periphery thereof with an insulator, and is unable to expand and contract. Although typical examples of an expandable electric cord include curl cords used in fixed telephones and the like, these are typically thick and heavy.

On the other hand, as an example of technology relating to an expandable electric cord, a method for using an elastic long fiber as a core and coiling a metal wire around the periphery thereof is disclosed in Japanese Examined Patent Publication No. S64-3967, which states that it is necessary for the relationship between the converted diameter (Ld) of the elastic long fiber and the converted diameter (Lm) of the metal wire to satisfy the expression $Ld/Lm \geqq 3$ (the definition of converted diameter and calculation method are described later), and that in the case of deviating from this range, expansion and contraction are either not demonstrated or it is not possible to form a stable loop, thereby preventing the obtaining of a satisfactory expandable cord.

In addition, Japanese Patent No. 3585465 discloses technology for braiding a metal wire around an elastic long fiber and covering by braiding an insulating fiber around the outer periphery thereof. It is also described as an application thereof that this technology can be used to transmit electrical signals such as those of a headphone using this expandable cord. Namely, this technology transmits weak current. Upon closer examination of the contents, an example is given in which a metal wire having a diameter of about 0.06 mm is braided onto an elastic long fiber having a diameter of about 0.8 mm. Although it is not disclosed as to how many metal wires are used for braiding, with reference to the drawings contained in this patent publication, when calculated in the case of using 16 metal wires, the converted diameter of the metal wire becomes 0.24 mm, and the relationship between the converted diameter of the elastic long fiber and the converted diameter of the metal wire (Ld/Lm) becomes $Ld/Lm=0.8/0.24=3.3$, thus exceeding 3.

Moreover, Japanese Unexamined Patent Publication No. 2004-134313 discloses technology in which a conductive wire is coiled in a helical form around an expandable core, and then a plurality thereof is gathered and covered in a cord-shape. According to a disclosed example of this patent publication, it is described that a conductive wire composed of a plurality of enamel wires having a diameter of 0.03 mm are coiled in a helical form around an 840 denier polyurethane elastic long fiber. The converted diameter of the 840 denier polyurethane long fiber based on the specific gravity of polyurethane of 1.2 becomes Ld=0.03 mm. Assuming that 9 enamel wires having a diameter of 0.03 mm were used, then the converted diameter of the enamel wires becomes 0.09 mm, and the relationship between the converted diameter Ld of the elastic long fiber and the converted diameter Lm of the metal wire in this patent publication as well becomes $Ld/Lm=0.32/0.09=3.6$, again exceeding a value of 3. In addition, it is described that an object of the invention of this patent publication is to provide an expandable electric cord capable of being applied to various types of signal cords, indicating it to be an expandable electric cord that handles weak current.

All of the technologies disclosed in these patent publications substantially consist of coiling a conductor wire directly around an elastic long fiber, and as long as they do not satisfy the expression $Ld/Lm \geqq 3$, are unable to realize expansion and contraction with respect to the rigidity of the conductor wire, or are unable to be coiled stably or form a uniformly looped shape as a result of being unable to completely oppose the elasticity generated during coiling of the elastic long fiber. Although technologies comprising the covering of an elastic long fiber with an insulating fiber are also disclosed, this sheath is provided for the purpose of reinforcement to prevent severing of the metal wire, and is not provided for the purpose of increasing the coiled diameter.

On the other hand, the prerequisites required of electric power cords include low electrical resistance and low generation of heat even when carrying a large current. The electrical resistance value is in a relationship of being inversely proportional to cross-sectional surface area for a given material, and conductor wires having a large cross-sectional area are required to produce expandable cords for electric power applications.

An expandable electric cord capable of carrying a desired current can be produced by fabricating in accordance with the technology disclosed in the aforementioned Japanese Examined Patent Publication No. 64-3967. However, since it is necessary to use a conductor wire having a large converted diameter in order to carry a large current, even in the case of using a copper wire considered to be the most common form of conductor wire, it is necessary to satisfy the expression $Ld/Lm \geqq 3$, thus requiring the use of an elastic long fiber having a large converted diameter.

Since an elastic long fiber having a large converted diameter has a large cross-sectional area and expresses strong elasticity, the expandable electric cord able to be obtained from such an elastic long fiber was such that it could only be stretched by pulling with considerable force.

On the other hand, robots have advanced considerably in recent years, which are capable of demonstrating various forms of movement. The wiring employed in such robots is required to have a large allowance for movement, and there are many cases in which this presents problems in terms of equipment design and practical use.

In addition, the power current in the latest humanoid robots is wired to operate terminal motors through multiple degree-of-freedom joints, thus creating a need for increasing the degree of freedom of wiring in these multiple degree-of-freedom joints.

Moreover, in the field of industrial robots as well, development is actively proceeding on robotic hands and the like, thus creating a demand for expandable electric cords capable of carrying not only low current but also large current for operating terminal motors, while also having heat resistance enabling them to be used even in high-temperature environments at factories.

Expandable electric cords and wires are also disclosed in, for example, Japanese Unexamined Patent Publication No. 2002-313145 and Japanese Unexamined Patent Publication No. 61-290603 in addition to the patent publications previously listed. Moreover, as an example of an electrically conductive elastic composite yarn, a technology for compounding elastic fibers and metal wire is disclosed in Japanese Unexamined Patent Publication No. 2006-524758. Each of these technologies uses organic elastic fibers exemplified by polyurethane elastic fibers, and is only suitable for applications involving the carrying of weak current in room temperature environments.

On the other hand, although there are various technologies relating to industrial robot cables including Japanese Examined Utility Model Publication No. 63-30096 relating to curling for the purpose of enhancing bendability, Japanese Examined Patent Publication No. 3-25494 relating to the composition, bendability and strength of copper wire, Japanese Unexamined Patent Publication No. 5-47237 relating to a polyether- or polycarbonate-based polyurethane elastomer sheath, and Japanese Patent No. 3296750 relating to a multi-conductor twisted wire composed of polyamide and polyurethane, these cables do not have expandability and were unsatisfactory for use as wiring for the joints of robots demonstrating a diverse range of movement.

Patent Document 1: Japanese Examined Patent Publication No. 64-3967

Patent Document 2: Japanese Patent No. 3585465

Patent Document 3: Japanese Unexamined Patent Publication No. 2004-134313

Patent Document 4: Japanese Unexamined Patent Publication No. 2002-313145

Patent Document 5: Japanese Unexamined Patent Publication No. 61-290603

Patent Document 6: Japanese Unexamined Patent Publication No. 2006-524758

Patent Document 7: Japanese Examined Utility Model Publication No. 63-30096

Patent Document 8: Japanese Examined Patent Publication No. 3-25494

Patent Document 9: Japanese Unexamined Patent Publication No. 5-47237

Patent Document 10: Japanese Patent No. 3296750

DISCLOSURE OF THE INVENTION

Problems to be Solved by the Invention

An object of the present invention is to provide an expandable electric cord not requiring a large force (energy loss) for expansion and contraction, able to carry a large current for driving electric power, and having expandability under a small load and low electrical resistance.

Means to Solve the Problems

As a result of extensive studies to obtain an expandable electric cord having expandability under a small load and low electrical resistance, the inventor of the present invention found that an expandable electric cord, having a structure at least comprised of a core portion, a conductor portion and a sheath portion, the core portion being an elastic cylinder composed of an elastic body and an intermediate layer covering the outer periphery thereof, the conductor portion containing a conductor wire composed of narrow stranded wires, with the conductor wire being coiled and/or braided around the outer periphery of the elastic cylinder, and the sheath portion being an outer sheath layer composed of an insulator that covers the outer periphery of the conductor portion, is able to carry a large current for driving electric power without requiring a large force (energy loss) for expansion and contraction, thereby leading to completion of the present invention.

Namely, the present invention is as described below:

(1) An expandable electric cord having a structure at least comprised of a core portion, a conductor portion and a sheath portion; wherein, the core portion is an elastic cylinder comprised of an elastic body and an intermediate layer covering the outer periphery thereof, the conductor portion contains a conductor wire comprised of narrow stranded wires, with the conductor wire being coiled and/or braided around the outer periphery of the elastic cylinder, and the sheath portion is an outer sheath layer comprised of an insulator that covers the outer periphery of the conductor portion.

(2) The expandable electric cord according to (1) above, wherein the elastic body is an elastic long fiber having ductility of 100% or more, or a coil spring having ductility of 50% or more.

(3) The expandable electric cord according to (1) or (2) above, wherein the thickness of the intermediate layer is within the range of 0.1 Ld (Ld: converted diameter of the elastic long fiber or outer diameter of the coil spring) or 0.1 mm, whichever is smaller, to 10 mm.

(4) The expandable electric cord according to any one of (1) to (3) above, wherein the 50% stretching stress of the elastic cylinder is 1 to 500 $cN/mm^2$.

(5) The expandable electric cord according to any one of (1) to (4) above, wherein the conductor wire is comprised of an electrical conductor having specific resistance of $10^{-4}$ Ω×cm or less.

(6) The expandable electric cord according to any one of (1) to (5) above, wherein the diameter of the narrow wire (Lt) is 1 mm or less.

(7) The expandable electric cord according to any one of (1) to (6) above, wherein the conductor wire contains 80% or more of copper or aluminum.

(8) The expandable electric cord according to any one of (1) to (7) above, wherein the conductor wire has an insulating sheath layer having a thickness of 1 mm or less for each narrow wire, or has an insulating sheath layer having a thickness of 2 mm or less for all of the stranded wires.

(9) The expandable electric cord according to any one of (1) to (8) above, wherein the conductor wire has an integration layer for integrating into the core section, and the integration layer is comprised of an elastic body having ductility of 50% or more.

(10) The expandable electric cord according to any one of (1) to (9) above, wherein the 30% stretch load is 5000 cN or less.

(11) The expandable electric cord according to any one of (1) to (10) above, wherein the conductor portion is comprised of a plurality of conductor wires.

(12) The expandable electric cord according to any one of (1) to (11) above, wherein the electrical resistance of a single conductor wire is 10 Ω/m or less.

(13) A process for producing an expandable electric cord having a structure at least comprised of a core portion, a conductor portion and a sheath portion; wherein, the core portion is an elastic cylinder comprised of an elastic body and an intermediate layer covering the outer periphery thereof, the conductor portion contains a conductor wire comprised of narrow stranded wires, with the conductor wire being coiled and/or braided around the outer periphery of the elastic cylinder, and the sheath portion is an outer sheath layer comprised of an insulator that covers the outer periphery of the conductor portion; the process comprising the following steps:

1) forming the elastic cylinder by braiding and/or coiling insulating fibers around the periphery of the elastic body while stretching the elastic body;

2) forming the conductor portion by coiling and/or braiding the conductor wire around the periphery of the resulting elastic cylinder while stretching the elastic cylinder; and 3) forming the outer sheath layer by braiding insulating fibers and/or covering an insulating resin around the periphery of the resulting structure comprised of the elastic cylinder and conductor portion or the structure subjected to further integration treatment while stretching the structure or the structure subjected to further integrated treatment.

(14) An expandable electric cord in the form of a narrow width, elastic tape, wherein a plurality of the expandable electric cords according to any one of (1) to (12) above are gathered into the form of a single narrow width, elastic tape while stretching.

Effects of the Invention

Since the expandable electric cord of the present invention has a 30% stretch load of 5000 cN or less and an electrical resistance of 10 Ω/m or less, it is able to carry a large current for driving electric power without requiring a large force (energy loss) for expansion and contraction, thereby allowing it to be used as an expandable electric cord suitable for practical use. Thus, the expandable electric cord of the present invention is optimal for use in the field of robotics in particular.

EXPLANATION OF THE REFERENCE SYMBOLS

| | |
|---|---|
| 1 | Elastic long fiber |
| 2 | Intermediate layer |
| 3 | Conductor wire |
| 4 | Outer sheath layer |
| 6 | Elastic cylinder |
| 10 | Coil spring |
| 20 | Sample |
| 21 | Chuck |
| 22 | Chuck |
| 23 | Stainless steel rod |

BEST MODE FOR CARRYING OUT THE INVENTION

The following provides a detailed explanation of the present invention.

Figure 1:
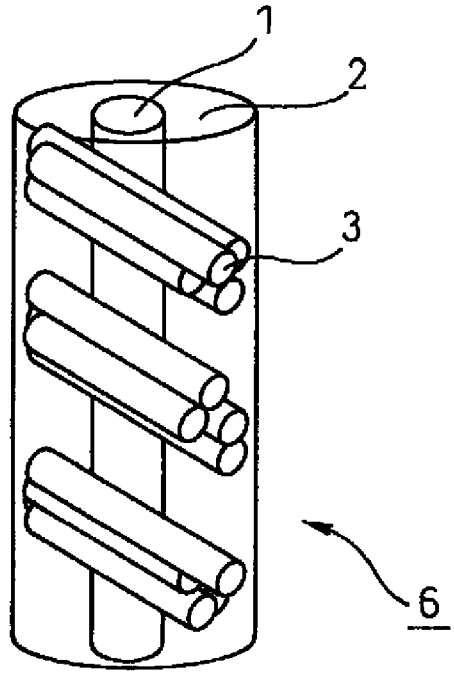
FIG. 1 is a drawing explaining the expandable electric cord of the present invention in the case of using an elastic long fiber for the elastic body.
Figure 2:
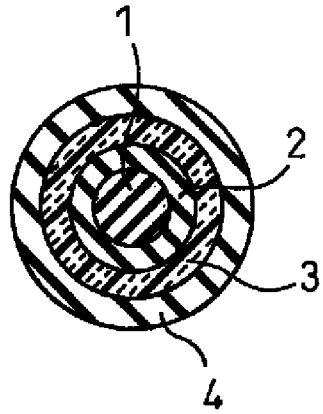
FIG. 2 is a schematic drawing of a horizontal cross-section of the expandable electric cord of the present invention in the case of using an elastic long fiber for the elastic body.
Figure 3:
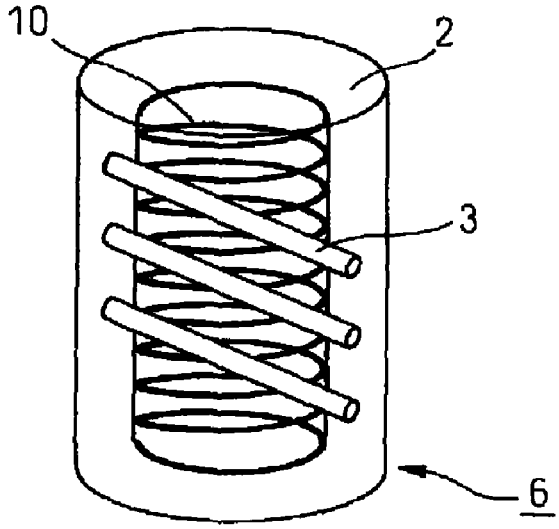
FIG. 3 is a drawing explaining the expandable electric cord of the present invention in the case of using a coil spring for the elastic body.
Figure 4:
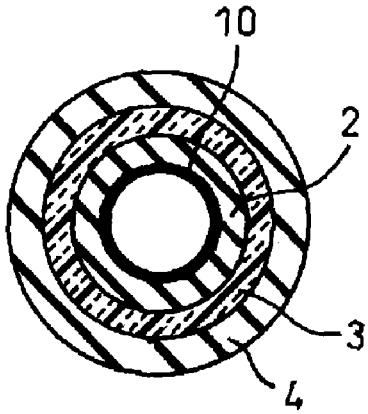
FIG. 4 is a schematic drawing of a horizontal cross-section of the expandable electric cord of the present invention in the case of using a coil spring for the elastic body.

The expandable electric cord of the present invention employs a basic structure in which a conductor wire composed of narrow stranded wires is coiled and/or braided around an elastic cylinder having an expandable intermediate layer arranged on the outer layer of an elastic long fiber as shown in FIG. 1 or FIG. 2, or a basic structure in which a conductor wire composed of narrow stranded wires is coiled and/or braided around an elastic cylinder having an expandable intermediate layer arranged on the outer layer of a coil spring as shown in FIG. 3 and FIG. 4. Furthermore, in the drawings, reference symbol 1 indicates an elastic long fiber, 2 an intermediate layer, 3 a conductor wire, 4 an outer sheath layer, 6 an elastic cylinder and 10 a coil spring. In addition, the outer sheath layer covering the outermost insulating fiber is not shown in FIG. 1 and FIG. 3.

Terms and symbols used in the present invention are defined as indicated below:

(1) Ld(mm): converted diameter of elastic long fiber or outer diameter of coil spring;

(2) Lc(mm): thickness of intermediate layer;

(3) Lm(mm): converted diameter of conductor wire; and (4) Lt(mm): diameter of narrow wire (conductor solid wire).

Furthermore, the definition of converted diameter and the method for determination thereof will be described hereinafter.

The expandable electric cord of the present invention at least has a core portion, a conductor portion and a sheath portion.

It is important that the core portion be an elastic cylinder composed of an elastic body and an intermediate layer covering the outer periphery thereof.

An elastic long fiber having ductility of 100% or more or a coil spring having ductility of 50% or more can be used for the elastic body.

The elastic long fiber used for the elastic body preferably has ductility of 100% or more. In the case that the ductility thereof is less than 100%, expansion and contraction performance lacks and it becomes difficult to produce an expandable electric cord that expands and contracts with low stress. The use of a long elastic fiber having ductility of 300% or more is more preferable.

There are no particular limitations on the type of polymer of the elastic long fiber used in the present invention provided it has ample ductility of 100% or more, and examples include polyurethane elastic long fiber, polyolefin elastic long fiber, polyester elastic long fiber, polyamide elastic long fiber, natural rubber elastic long fiber, synthetic rubber elastic long fiber and composite rubber elastic long fiber consisting of natural rubber and synthetic rubber.

Polyurethane elastic long fiber is optimally used for the elastic long fiber of the present invention due to its large elongation and superior durability.

Natural rubber long fiber offers the advantages of having less stress per cross-sectional area than other elastic long fiber, allowing the thickness of the intermediate layer to be reduced, and facilitating the obtaining of a desired elastic cylinder. However, it is difficult to maintain expandability over an extended period of time due to susceptibility to deterioration. Thus, it is preferable for applications designed for short-term use.

Although synthetic rubber elastic long fiber has superior durability, it is difficult to obtain fibers having large elongation. Thus, it is suitable for applications not requiring excessively large elongation.

The elastic long fiber may be a monofilament or multifilament.

The converted diameter (Ld) of the elastic long fiber is preferably within the range of 0.01 to 10 mm, more preferably within the range of 0.02 to 5 mm and even more preferably within the range of 0.03 to 3 mm. In the case Ld is 0.01 mm or less, expandability is unable to be obtained, while if Ld exceeds 10 mm, a large force is required during stretching.

An intermediate layer of large thickness and an elastic long fiber can be easily integrated (in which the elastic long fiber and intermediate layer are not allowed to move separately) by using a two-ply yarn or multi-strand twisted yarn for the elastic long fiber, or by using the elastic long fiber for the core and coiling another elastic long fiber there around.

The coil spring used as an elastic body in the present invention is preferably made of metal. A metal coil spring does not deteriorate at high temperatures, and is suitable for applications used in high-temperature environments. Although a coil spring not made of metal can be used, such coil springs are inferior to metal coil springs in terms of repetitive deformation and heat resistance. A coil-shaped spring can be arbitrarily designed by selecting the coiling machine and setting the conditions of the selected coiling machine.

The relationship between coil diameter D and drawn wire (referring to the wire material used to form the coils) diameter d is preferably such that 24>D/d>4. In the case D/d is 24 or more, a spring having a stable shape is unable to be obtained and is easily deformed, thus making this undesirable. On the other hand, if D/d is 4 or less, in addition to it being difficult to form a coil, it is also difficult for the spring to express expandability. Thus, the value of D/d is preferably 6 or more.

The drawn wire diameter d is preferably 3 mm or less. If d is 3 mm or more, the spring becomes heavy resulting in increases in expansion stress and coil diameter, thereby making this undesirable. On the other hand, if the drawn wire diameter d is 0.01 mm or less, a spring capable of being formed is excessively weak, causing it to be easily deformed when subjected to force from the side, thereby making this impractical.

The pitch interval of the coils is preferably ½ D or less. Although a coil-shaped spring can be formed even if the interval is greater than this, it becomes difficult to form the intermediate layer around the periphery of the coils. Moreover, this also results in decreased expandability and greater susceptibility to deformation by external forces, thereby making this undesirable. Thus, the pitch interval of the coils is preferably 1/10 D or less.

A coil spring in which the pitch interval is nearly zero is able to demonstrate the greatest expandability, the spring itself is less likely to become tangled, and a coiled spring can be pulled out easily, while also offering the advantage of being resistant to deformation by external forces, thereby making this preferable.

The outer diameter (Ld) of the coil spring is preferably within the range of 0.02 to 30 mm, more preferably within the range of 0.05 to 20 mm, and even more preferably within the range of 0.01 to 10 mm. A coil spring having an outer diameter of 0.02 mm or less is difficult to manufacture, and if the outer diameter exceeds 30 mm, the outer diameter of the expandable electric cord becomes excessively large, thereby making this undesirable.

The material of the coil spring can be arbitrarily selected from the materials of known drawn wires. Examples of wire materials include piano wire, hard drawn steel wire, stainless steel wire, oil-tempered wire, phosphor bronze wire, beryllium copper wire and nickel silver wire. Stainless steel wire is preferable from the viewpoint of its superior corrosion resistance and heat resistance as well as its ease of acquisition.

A continuous coil spring can be obtained by coiling a drawn wire with a coiling machine and carrying out quenching and cooling as necessary.

When using a coiled coil spring in a subsequent process, the coils may become overlapped making it difficult to pull them out. This can be easily accommodated by wrapping layers of a narrow width tape around the coil spring.

In the case of using either a long elastic fiber or coil spring for the elastic body, it is necessary that the elastic body have a layer referred to as an intermediate layer composed of an insulating fiber around the periphery thereof.

The formation of an intermediate layer enables the coiled diameter of the conductor wire to be increased and a thick conductor wire to be coiled. In addition, in the case of using a coil spring for the elastic body, the conductor wire can be coiled while preventing the conductor wire from being trapped in the gaps of the coils.

In any case, the 50% stretching stress of the elastic cylinder in the state of forming an intermediate layer is preferably 1 to 500 $cN/mm^2$, more preferably 1 to 200 $cN/mm^2$, even more preferably 5 to 100 $cN/mm^2$ and particularly preferably 10 to 50 $cN/mm^2$. If the 50% stretching stress is within this range, expandability with low stress is favorable, and in the case the 50% stretching stress is 1 $cN/mm^2$ or less, it is difficult to express expandability, while in the case the 50% stretching stress exceeds 500 $cN/mm^2$, a large force is required for stretching, which is not preferable in practical terms.

The insulating fiber that composes the intermediate layer (to be referred to as insulating fiber I) may be a multifilament or spun yarn. A known insulating fiber can be arbitrarily selected corresponding to the application and usage conditions of the expandable electric cord provided it is unlikely to inhibit expandability of the elastic long fiber and has insulating properties. Examples of insulating fiber from the viewpoint of light weight and bulkiness include bulky multifilaments (such as wooly nylon or ester wooly yarn), various types of bulky textured yarns (such as false-twist textured yarn or acrylic bulky yarn), and various types of spun yarns (such as ester spun yarn). In the case of desiring light weight, polyethylene fiber or polypropylene fiber can also be used. In the case of emphasizing flame retardation, saran fiber, fluoride fiber, flame-proof acrylic fiber, polysulfone fiber or flame-proofed flame retardant polyester fiber, flame retardant nylon fiber or flame retardant acrylic fiber and the like can be used. In the case of placing priority on price, general-purpose polyester fiber, nylon fiber or acrylic fiber and the like can be used.

In the case of using a coil spring for the elastic body, a material having superior wear resistance is preferable since the insulating fiber I is present between the coil spring and the conductor wire. The use of fluorine fiber is preferable in terms of high heat resistance and superior wear resistance. However, in terms of practical use, the insulating fiber is not limited thereto, but rather the insulating fiber can be arbitrarily selected from the insulating fibers indicated above in consideration of practical performance and price corresponding to the particular application.

Examples of insulating fibers having superior heat resistance include aramid fiber and polyphenylene sulfide fiber. In the case of emphasizing universality, examples of insulating fibers include nylon fiber and polyester fiber. In the case of requiring flame-proofing, examples of insulating fibers include glass fiber, inorganic fiber, fluorine fiber, flame-proof acrylic fiber and saran fiber.

In addition, in the case of using a coil spring for the elastic body, the core braided sheath composed of the aforementioned insulating fiber is preferably bulky. Since both the inside and outside of the braided sheath are composed of a hard material (metal), it fulfills the role of a cushioning material. In addition, a bulky braided sheath makes it possible to obtain the effect of making it difficult for the conductor wire coiled thereon to shift out of position.

A bulky braided sheath is obtained by using a bulky multifilament or spun yarn, and braiding without being excessively tight. Excessively coarse braiding is undesirable since it results in inadequate covering.

A bulky multifilament or spun yarn can be obtained by a known method. For example, one or more types of multifilaments are stretched out and aligned followed by false-twist texturing, or a conjugate yarn multifilament can be used. In addition, in the case of spun yarn, bulkiness can be obtained by blending and spinning one or more types of short fibers. A highly bulky spun yarn can be obtained in particular by blending, spinning and heat treating short fibers having different rates of heat shrinkage.

Examples of general-purpose insulating fibers having satisfactory wear resistance and bulkiness include wooly nylon and ester wooly yarn. In addition, insulating fibers having superior wear resistance can also be combined with bulky insulating fibers (either by blended spinning, yarn blending or covering in multiple layers).

It is necessary for the thickness Lc of the intermediate layer to be such that 10 mm>Lc≧0.1 Ld or 0.1 mm, whichever is smaller, and preferably such that 10 mm>Lc≧0.3 Ld or 0.1 mm, whichever is smaller. There are no particular limitations on the method used to produce the intermediate layer provided a thickness within this range can be ensured without impairing expandability. The thickness of the intermediate layer is preferably less than 10 mm, and if given a thickness greater than or equal to 10 mm, the outer diameter of the ultimately obtained expandable electric cord becomes excessively large, resulting in a thick cord that is not preferable in practical terms. In addition, if the thickness of the intermediate layer is less than 0.1 Ld or 0.1 mm, whichever is smaller, the effect of increasing the coiled diameter of the conductor wire is diminished, thereby making it difficult to coil a conductor wire having a large converted diameter.

The intermediate layer can be obtained by forming an intermediate layer by covering the stretched long elastic fiber or coil spring, and preferably while stretched by 50% or more, at least once with a braided insulating fiber by using the long elastic fiber or coil spring as a core, by forming an intermediate layer by coiling a filament or spun yarn of an insulating fiber two or more times, or by forming an intermediate layer by coiling a filament or spun yarn of an insulating fiber one or more times followed by further covering at least once with a braided insulating fiber.

At this time, after obtaining an elastic cylinder by forming the intermediate layer on the elastic body in advance, the elastic cylinder is preferably then stretched again followed by coiling and/or braiding the conductor wire. Although an example of a so-called double covered yarn is disclosed in the prior art consisting of coiling an insulating fiber in advance followed immediately thereafter by coiling a metal wire, in this case, there are problems such as not being able to obtain stable coiling as a result of being unable to obtain adequate resistance to the coiling tension of the metal wire, or being unable to form a uniform loop form.

As a result of being able to increase the coiled diameter of the conductor wire and allow the intermediate layer to demonstrate resistance to the coiling tension of the conductor wire by stretching the elastic cylinder and coiling the conductor wire after having initially formed the intermediate layer to obtain the elastic cylinder, it was found that the present invention is able to realize stable coiling even within the range of Ld/Lm<3, which was considered to be impossible in the prior art.

Although the use of thick yarn was typically considered to be necessary for the insulating fiber in order to obtain a large thickness for the intermediate layer, simply the use of a thick yarn alone results in increased susceptibility to the occurrence of phenomena that makes it difficult to demonstrate expandability or makes it difficult for the elastic body and intermediate layer to move in coordination. Examples of methods used to prevent this include a method in which an elastic long fiber is used that has been covered in advance with an insulating fiber, and a method in which covering is achieved by braiding multiple times. More preferably, the use of that in which the long elastic fiber itself is in the form of a two-ply yarn or three-, four- or multi-strand twisted yarn is effective. This is because twisting causes the elastic long fiber to expand, and in the case of providing a rope-like covering, has the effect of absorbing volumetric changes in the internal spaces of the rope-like sheath caused by expansion and contraction, thereby facilitating the obtaining of a stable expanded form.

In addition, pre-coiling a different elastic long fiber around the elastic long fiber is also effective. An elastic long fiber coiled with another elastic long fiber acts as an integrated elastic body, and allows the obtaining of effects similar to those described above.

Although the intermediate layer is not limited to that described above, but rather can also be obtained by other methods, a substantially cylindrical shape is preferable. In any case, the 50% stretching stress of the elastic cylinder is preferably 1 to 500 cN/mm$^2$.

The ductility of the elastic cylinder formed with an intermediate layer is preferably 50% or more and more preferably 100% or more. In the case ductility is low at less than 50%, elongation of the conductor wire and outer sheath layer by the sheath decreases resulting in an expandable electric cord having low expandability. Although the greater the ductility the better, it is frequently 300% or less as a result of forming the intermediate layer.

It is important that the 50% stretching stress of the elastic cylinder be designed to be 1 to 500 cN/mm$^2$, more preferably designed to be 1 to 200 cN/mm$^2$, even more preferably designed to be 5 to 100 cN/mm$^2$, and particularly preferably designed to be 10 to 50 cN/mm$^2$. If the stretching stress is within this range, the elastic cylinder is able to expand and contract at low stress, thereby allowing the obtaining of an expandable electric cord having low resistance.

It is necessary that the conductor wire consist of two or more narrow stranded wires. The use of narrow stranded wires increases the flexibility of the conductor wire making it difficult for the conductor wire to inhibit expandability. In addition, this is also results in greater resistance to wire breakage in practical terms.

There are various known methods for forming narrow wires into stranded wires, and narrow wires may be formed into stranded wires by any known method in the present invention as well. However, since coiling is difficult simply by pulling out straight and aligning, it is preferable to use in the form of twisted wires. In addition, stranded wires can be used that have been coiled with insulating fiber to demonstrate flexibility.

The diameter of a single stranded wire that composes the conductor wire is preferably 1 mm or less, more preferably 0.1 mm or less, particularly preferably 0.08 mm or less, and most preferably 0.05 mm or less. If the diameter of a single wire exceeds 1 mm, expandability is impaired and susceptibility to wire breakage due to expansion and contraction increases. Since an excessively narrow wire diameter results in greater susceptibility to wire breakage during processing, the diameter of a single stranded wire is preferably 0.01 mm or more.

The coiling or braiding angle of the conductor wire (to be exemplarily referred to as the coiling angle) is preferably within the range of 30 to 80 degrees. In the case the coiling angle is less than 30 degrees, it becomes difficult to demonstrate expandability. The coiling angle is more preferably 35 degrees or more, particularly preferably 40 degrees or more and most preferably 50 degrees or more. If the coiling angle exceeds 80 degrees, the length of coiled conductor wire per unit length becomes excessively long, thereby making this undesirable. Thus, the coiling angle is more preferably 75 degrees or less and particularly preferably 70 degrees or less.

Figure 5:
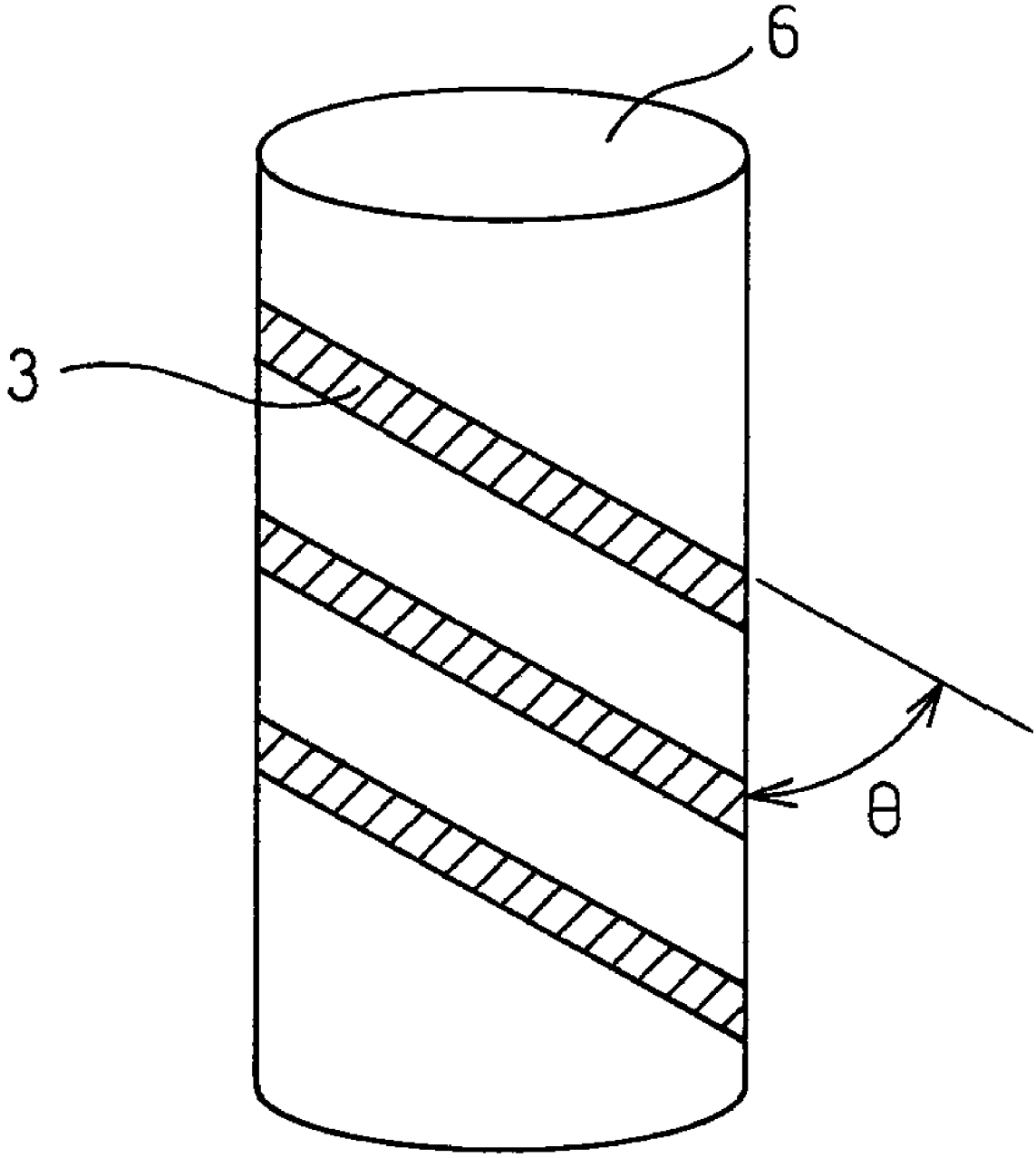
FIG. 5 is a drawing explaining coiling angle.

As shown in FIG. 5, coiling angle in the present invention refers to an angle θ of a coiled or braided conductor wire to the direction of length of the elastic cylinder, and normally refers to the angle in the relaxed state. Coiling angle is determined using an inverse trigonometric function by cutting off a 20 cm length of sample in the relaxed state, unraveling the coiled conductor wire and measuring the length thereof. Furthermore, the coiling angle during coiling of the conductor wire (when the elastic cylinder is in a prescribed stretched state) is referred to as the coiling angle during coiling in the present description.

The conductor wire is required to have a specific resistance of $10^{-4}$ Ω×cm or less, and if this value is exceeded, it becomes necessary to use a conductor wire having a large cross-sectional area in order to decrease the electrical resistance value thereof, thus making this unsuitable in practical terms. The specific resistance of the conductor wire is preferably $10^{-5}$ Ω×cm or less.

The conductor wire is preferably a copper wire composed of 80% by weight or more of copper, or an aluminum wire composed of 80% by weight or more of aluminum. Copper wire is the most preferable since it is comparatively inexpensive and demonstrates low electrical resistance. Aluminum wire is the next most preferable after copper wire due to its light weight. Although copper wire is typically annealed copper wire or copper-tin alloy wire, high-strength copper alloys, in which strength has been enhanced without significantly lowering electrical conductivity (such as oxygen-free copper to which lead, phosphorous and indium and the like have been added), that plated with tin, gold, silver or platinum to prevent oxidation, or that surface-treated with gold or other element to improve transmission characteristics of electrical signals can also be used.

Narrow wires covered with an insulator can also be used for each of the narrow wires that compose the conductor wire. Since the expandable electric cord of the present invention does not employ a structure in which the conductor wire is completely isolated from outside air, if bare wires are used for the narrow wires, the surface of the conductor wire is susceptible to oxidation and deterioration. Thus, the narrow wires themselves are preferably covered with an insulating resin in advance.

Narrow stranded wires can also be collectively covered with an insulating resin.

It is important that the insulated stranded wires be flexible and have a small outer diameter. Consequently, in the case of covering individual narrow wires, the thickness of the resin sheath is preferably 1 mm or less and more preferably 0.1 mm or less. In the case of collectively covering stranded wires, the thickness of the resin sheath is preferably 2 mm or less and more preferably 1 mm or less. The type of resin sheath can be arbitrarily selected from known insulating resin sheaths in line with the purpose of use as described above.

In the case of covering each narrow wire with an insulator in advance, examples of so-called enamel sheaths used with ordinary magnet wires include a polyurethane sheath, polyurethane-nylon sheath, polyester sheath, polyester-nylon sheath, polyester-imide sheath and polyesterimide-polyamideimide sheath.

In addition, in the case of covering after forming into a stranded wire, examples of resins that can be used include vinyl chloride resin, polyolefin resin, fluorine resin, urethane resin and ester resin.

The converted diameter of a single-coiled conductor wire per coiling of the conductor wire is preferably 5 mm or less, more preferably 3 mm or less, and even more preferably 2 mm or less. In the case of a stranded wire composed of narrow wires as well, a converted diameter of greater than 5 mm results in insufficient flexibility thereby preventing stable coiling. In addition, it is necessary for the converted diameter of the conductor wire to be 0.01 mm or more in terms of workability during coiling or braiding, and is preferably 0.03 mm or more, more preferably 0.05 mm or more, and particularly preferably 0.1 mm or more.

In the case a large converted diameter is required for use as an electric power cord, the conductor wire is preferably coiled after dividing into stranded wires having a converted diameter of 3 mm or less. Conversely, if the converted diameter is too small, the number of divisions can be increased. However, since this results in poor workability, the number of divisions is preferably 10 or less.

In the case of coiling the conductor wire a plurality of times, the conductor wire can be coiled by alternating between Z twists and S twists, or the conductor wire can be coiled in one direction only. Since friction between the conductor wires after coiling causes wire breakage, the conductor wire is preferably coiled in one direction only. Coiling can be carried out a plurality of times one wire at a time or carried out on a plurality of wires at a time. Since it is difficult to ensure parallelism in the case of coiling a plurality of wires in the same direction, it is preferable to first align a plurality of wires on a single bobbin followed by coiling this one time.

In addition, each conductor wire can be color-coded in advance for identification purposes. A plurality of coiled conductor wires can be collectively treated as a single electric wire, or each conductor wire can be individually treated as an electric wire.

In the case of using a long fiber for the elastic body, the value of Ld/Lm is preferably 0.1 to less than 3 and particularly preferably 0.5 to 2.5. If this value is less than 0.1, it becomes difficult to demonstrate expandability. In the case this value is 3 or more, the resulting electric wire either requires considerable force for expansion and contraction or is only able to carry a weak current, thereby causing the electric wire to lack practicality.

In addition, in the case of using a coil spring for the elastic body, the value of Ld/Lm is preferably within the range of 0.1 to 30 and particularly preferably within the range of 0.5 to 20. If this value is less than 0.1, it becomes difficult to demonstrate expandability, while if the value exceeds 30, the outer diameter of the coil spring relative to the conductor wire becomes excessively large, resulting in an excessively thick expandable electric cord, and thereby making this undesirable.

The conductor wire can also be braided around the outer periphery of the elastic cylinder. A plurality of conductor wires can be braided or a conductor wire can be braided in combination with an insulating fiber. The conductor wire may be braided in one direction or two directions. The conductor wire is preferably braided in one direction while an insulating fiber is preferably braided in the opposite direction to prevent abrasion between conductor wires caused by expansion and contraction. Moreover, an insulating fiber can be arranged between a plurality of conductor wires braided in one direction, or an insulating fiber can be arranged in the opposite direction. This method is particularly effective since short-circuiting caused by overlapping of conductor wires can be reduced.

In addition, in an expandable electric cord having a plurality of conductor wires, there are many cases in which there are two signal wires and two electric power wires. In such cases, if the interval between the signal wires is unequal, the characteristic impedance between the signal wires becomes unequal resulting in the problem of increased transmission loss (and particularly at high frequencies). A structure in which a plurality of conductor wires are braided in one direction while an insulating fiber is braided in the opposite direction, or that in which an insulating fiber is arranged in the same direction between a plurality of conductor wires and an insulating fiber is braided in the opposite direction, is particularly preferable for reducing transmission loss.

A conductor wire that has been covered in advance with an insulating fiber (to be referred to as insulating fiber II) can also be used. A known insulating fiber can be used for the insulating fiber used at this time, examples of which include fluorine fiber, polyester fiber, nylon fiber, polypropylene fiber, vinyl chloride fiber, saran fiber, glass fiber and polyurethane fiber. The conductor wire can be covered by coiling and/or braiding with this insulating fiber II. Increasing the thickness of this sheath composed of insulating fiber makes it possible to substantially increase the coiled diameter when coiling on the elastic body.

A conductor wire covered in advance with an insulating fiber is preferable since it is resistant to damage to the insulating resin layer of the narrow wire surface layer during processing.

It is necessary to coil or braid a single conductor wire or plurality of conductor wires while the elastic cylinder is stretched. The elastic cylinder is preferably stretched 30% or more, more preferably 50% or more and particularly preferably 100% or more to facilitate the demonstration of expandability.

An integration layer consisting of an elastic material can also be provided as necessary before providing the sheath portion after having coiled or braided the conductor wire on the elastic cylinder. Since the main purpose for providing this integration layer is to prevent the conductor wire and elastic cylinder from shifting out of position, this layer is not necessarily required to be a continuous layer provided it is within a range that is able to achieve this objective.

The integration layer can be formed by either coiling or braiding the conductor wire on the elastic cylinder followed by immersing the resulting structure in an elastic material in a liquid state, or by imparting an elastic material in a liquid state to at least the coiled or braided conductor wire followed by removing the liquid as necessary and either promoting the reaction or drying by heating or solidifying by cooling.

The viscosity of the liquid elastic material is preferably 2000 poise or less in order to form a thin integration film having superior flexibility. In the case of a higher viscosity, it becomes difficult to form a thin film, while also making it difficult for the liquid elastic material to penetrate into the gaps between the conductor wire and elastic cylinder.

A mixed two-liquid reactive polyurethane elastic material, polyurethane elastic material dissolved in a solvent, latex-type natural rubber elastic material or latex-type synthetic rubber elastic material can be used for the liquid elastic material to form a thin film.

The providing of an integration layer consisting of an elastic material makes it possible to prevent the conductor wire and elastic cylinder from shifting out of position due to expansion and contraction, while also improving practical durability.

The sheath portion is formed after coiling or braiding the conductor wire on the elastic cylinder and either using as is or integrating with the elastic cylinder in the manner described above.

The sheath portion is required to protect the conductor wire inside without impairing expandability. Consequently, it is preferable formed by braiding an insulating fiber (to be referred to as insulating fiber III) and/or an elastic tube of an insulating resin having ductility of 50% or more.

A multifilament or spun yarn can be used for the insulating fiber III. A monofilament is not preferable due to its poor coverage.

The insulating fiber III can be arbitrarily selected from known insulating fibers according to the application and presumed usage conditions of the expandable electric cord. Although the insulating fiber III may use a raw yarn as is, a spun-dyed yarn or pre-dyed yarn can also be used from the viewpoint of design and prevention of deterioration. Flexibility and abrasiveness can be improved by finishing. Moreover, handling at the time of actual use can also be improved by carrying out known fiber processing, such as flame retardation, water repellency, oil repellency, soiling resistance, antimicrobial, bacteriostasis and deodorizing processing.

Examples of the insulating fiber III realizing both heat resistance and wear resistance include aramid fiber, polysulfone fiber and fluorine fiber. Examples from the viewpoint of flame retardation include glass fiber, flameproof acrylic fiber, fluorine fiber and saran fiber. High-strength polyethylene fiber and polyketone fiber are added from the viewpoint of wear resistance and strength. Examples of insulating fiber III used from the viewpoint of cost and heat resistance include polyester fiber, nylon fiber and acrylic fiber. Flame-retardant polyester fiber, flame-retardant nylon fiber and flame-retardant acrylic fiber (modacrylic fiber), imparted with flame retardation, are also preferable for these fibers. Non-melting fibers are preferable used for local deterioration caused by frictional heat, examples of which include aramid fiber, polysulfone fiber, cotton, rayon, cuprammonium rayon, wool, silk and acrylic fiber. In the case of emphasizing strength, examples include high-strength polyethylene fiber, aramid fiber and polyphenylene sulfide fiber. In the case of emphasizing abrasiveness, examples include fluorine fiber, nylon fiber and polyester fiber.

In the case of emphasizing design, acrylic fiber demonstrating favorable coloring can also be used.

Moreover, in the case of emphasizing feel resulting from human contact, cellulose-based fibers such as cuprammonium rayon, acetate, cotton and rayon, or silk and synthetic fibers having a narrow fiber fineness can be used.

In the covering of the outermost layer with insulating fiber III, a braided fiber is preferable for the purpose of protecting the inside. The final form may be a circular braid or narrow width tape.

A plurality of elastic cylinders in which the conductor wire is coiled or braided can be combined followed by covering the periphery thereof with the insulating fiber III, or a plurality of elastic cylinders covered in advance with the insulating fiber III can be combined followed by further covering the periphery thereof with the insulating fiber III. Simultaneously coiling a plurality of conductor wires and then covering the periphery thereof with the insulating fiber III yields the most compact form.

The sheath portion can also be formed by an elastic tube made of an insulating resin.

The insulating resin can be arbitrarily selected from various elastic insulating resins, and can be selected while taking into consideration the application of the expandable electric cord and compatibility with the other insulating fibers I and II used.

Examples of performance taken into consideration include wear resistance, heat resistance and chemical resistance, and synthetic rubber-based elastic materials are an example of that which is superior in terms of these examples of performance, with fluorine rubber, silicone rubber, ethylene-propylene rubber, chloroprene rubber and butyl rubber being preferable.

An elastic tube made of an insulating resin can be preferably used in the case of desiring to enhance coverage protection from a liquid.

The outer sheath layer composed of an insulator can also combine that braided with insulating fiber III and an elastic tube. Although there are many cases in which the expandable electric cord is desired to expand and contract with a small force, in the case of covering with an elastic tube only, the thickness of the tube tends to increase, resulting in a greater likelihood of an increase in the force during expansion and contraction. In such cases, combining a thin tube with braid composed of insulating fiber III makes it possible to realize both coverage and expandability.

The electrical resistance of an expandable electric cord obtained in this manner when in the relaxed state is preferably 10 Ω/m or less. In the case of greater electrical resistance, the resulting expandable electric cord is not suitable for carrying a drive current even though it may be able to carry a weak current. Thus, the electrical resistance is more preferably 1 Ω/m or less.

In addition, the 30% stretch load of the expandable electric cord of the present invention is preferably 5000 cN or less and more preferably 1000 cN or less. Since an expandable electric cord required for practical use does not require a large load (force) for stretching, if the 30% stretch load exceeds 5000 cN, problems may result in terms of practical use.

A narrow width elastic tape can also be produced by braiding a plurality of expandable electric cords.

In order to obtain a narrow width elastic tape, 2 to 100 pre-insulated expandable electric cords are preferably used. Although 3 to 5 cords are used for general usage, since there are also cases in which it is desired to wire a large number of motors and sensors from a power supply to a terminal with a single tape, a large number of expandable electric cords can also be formed into a tape. Although a single tape can be formed using 100 or more expandable electric cords, it is necessary to replace a tape comprised of 100 cords even if there is an abnormality in only a portion of the wiring, thereby making this undesirable. In terms of handling, the width of the tape is 20 cm or less and preferably 10 cm or less.

EXAMPLES

Although the following provides an explanation of the present invention based on examples and comparative examples thereof, the present invention is not limited to only these examples.

The evaluation methods used in the present invention are as described below.

(1) Determination of Elastic Long Fiber Converted Diameter Ld and Conductor Wire Converted Diameter Lm:

Converted diameter refers to the diameter in the case of viewing the relevant fiber or conductor wire in question as a single cylinder.

Furthermore, diameter and thickness as treated in the present invention were values obtained in the state of having removed all tension.

Elastic long fiber converted diameter Ld (mm):

$$Ld = 2 \times 10\ (\text{mm/cm}) \times \sqrt{(D/(d \times \pi \times 1000000\ (\text{cm})))}$$
$$= 2 \times \left(\sqrt{(D/d \times \pi)}\right)/100$$

D: Fiber fineness of elastic long fiber (dtex)

d: Specific gravity of elastic long fiber (g/cm$^3$)

Furthermore, the outer diameter Ld of a coil spring is measured with a caliper.

Conductor wire converted diameter Lm (mm):

$$Lm=2\times\sqrt{((\pi\times(Lt/2)\times(Lt/2)\times n)/\pi)}=Lt\times\sqrt{Vn}$$

Lt: Diameter of narrow wires composing conductor wire n: Number of stranded wires of narrow wires composing conductor wire (2) Determination of Intermediate Layer Thickness Lc:

The outer diameter of the elastic cylinder (elastic body+intermediate layer) is measured with a caliper at 5 locations, and the resulting average value is taken to be La. Intermediate layer thickness Lc is then determined using the following formula.

$$Lc=(La-Ld)/2$$

(3) Processability:

Processability was evaluated according to the following criteria for 10 minutes in the case of coiling a conductor wire by coiling under prescribed conditions at a feeding speed of 3 m/min with a Kataoka covering machine.

○: Continuous operation possible for 10 minutes without abnormalities

Δ: Unstable ballooning and fluctuations during the 10 minute evaluation period

X: Unable to operate continuously for 10 minutes (4) Loop Form:

Loop form following coiling was observed for 100 loops with a 10× magnifier and evaluated according to the following criteria based on the number of loops having a different size or shape as compared with other loops among the 100 observed loops.

X: 10 or more

Δ: 3 to 9

○: 2 or less (5) 30% and 50% Stretch Loads:

After allowing a sample to stand undisturbed for 2 hours in a standard state (temperature: 20° C., relative humidity: 65%), a sample having a length of 100 mm was stretched at a drawing rate of 500 mm/min using a Tensilon Universal Material Testing Instrument (A & D Co., Ltd.) while in the standard state to determine the 30% and 50% stretch loads.

(6) 50% Stretching Stress:

After allowing a sample to stand undisturbed for 2 hours in a standard state (temperature: 20° C., relative humidity: 65%), a sample having a length of 100 mm was stretched at a drawing rate of 500 mm/min using a Tensilon Universal Material Testing Instrument while in the standard state to determine the load during 50% stretching (XcN), followed by dividing by the cross-sectional area (Ym) of an elastic cylinder of the sample to determine the 50% stretching stress ($X/Y=ZcN/mm^2$).

(7) 50% Stretch Recovery:

A sample having a length of 100 mm was stretched at a drawing rate of 500 mm/min using a Tensilon Universal Material Testing Instrument and then returned after stretching by 50% to determine the distance at which stress reaches zero (Amm) along with the recovery rate according to the following formula.

$$\text{Recovery rate (\%)}=((100-A)/100)\times 100$$

Recovery is evaluated according to the following criteria.

○: Recovery rate of 80% or more

Δ: Recovery rate of 50% or more

X: Recovery rate of less than 50%

(8) Electrical Resistance:

A sample measuring 1 m was cut out while in the relaxed state and electrical resistance was measured at both ends using the Milliohm Tester 3540 (Hioki E.E. Corp.).

(9) Heat-Generating Current:

A prescribed current was applied to both ends of a sample measuring 1 m in length while in the relaxed state at room temperature, the temperature of the expandable electric cord coating was measured for 30 minutes with a radiation thermometer (3445, Hioki E.E. Corp.), the sample was evaluated according to the following criteria based on the temperature rise ΔT, and the current responsible for evaluation Δ was defined as heat-generating current.

○: $\Delta T \leqq 5°$ C.

Δ: $5°$ C.$<\Delta T \leqq 20°$ C.

X: $\Delta T > 20°$ C.

Figure 6:
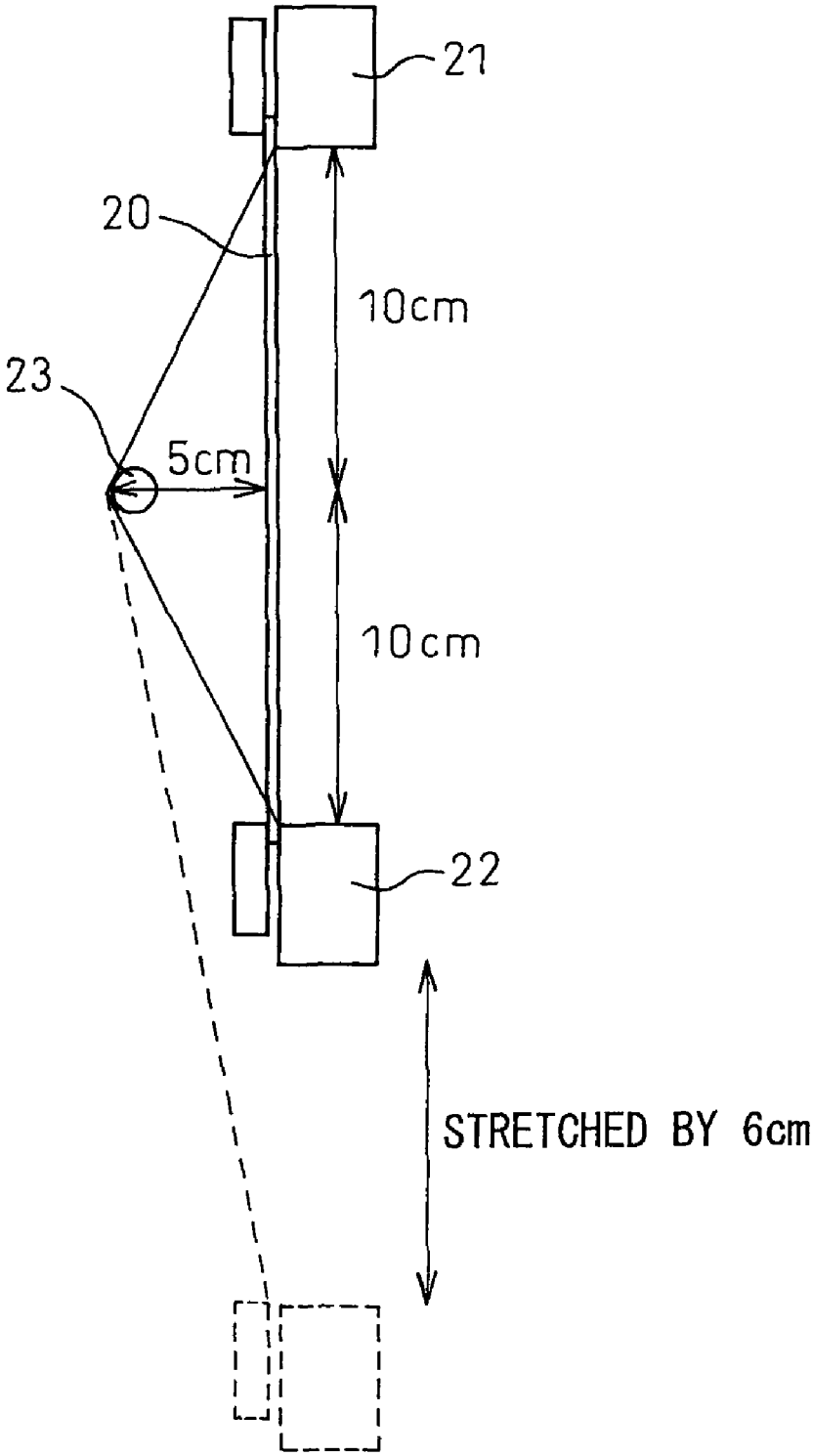
FIG. 6 is a schematic drawing of a repetitive stretchability measuring apparatus.

(10) Repetitive Expandability:

A chuck (21) and a chuck (22) were attached to a sample measuring 20 cm in length as shown in FIG. 6 using a Dematcher Tester (Daiei Kagaku Seiki Mfg. Co., Ltd.), and a stainless steel rod (23) having a diameter of 1.27 cm was positioned there between. The moving position of chuck (22) was set to 26 cm equal to the length of the sample when stretched, followed by repeatedly expanding and contracting for a prescribed number of times at the rate of 60 times/minute at an initial stretching of 11% and stretching of 40% when drawn to evaluate repetitive expandability by measuring electrical resistance (40% stretching) before and after testing.

○: No change in electrical resistance value after repeatedly expanding and contracting 100,000 times Δ: No change in electrical resistance value after repeatedly expanding and contracting 10,000 times, but large change in electrical resistance value after repeatedly expanding and contracting 100,000 times X: Large change in electrical resistance value after repeatedly expanding and contracting 10,000 times

(11) Heat Resistance:

Marks were made on a sample indicating a distance of 100 mm while in the relaxed state, after which the distance between the marks was stretched by 25 mm so that the sample was stretched by 25% and the sample was fixed in a metal frame. While in this stretched state, the sample was heat-treated for 16 hours in a dryer set to 120° C. Following heat treatment and cooling by allowing to stand at room temperature for 15 minutes, the sample was removed from the metal frame. The distance between the marks was then measured after allowing the sample to relax for 15 minutes at room temperature.

Deterioration was evaluated according to the following criteria based on the recovery rate determined using the formula below.

$$\text{Recovery rate } T\text{ (\%)}=100\times(25-(\text{length after heat treatment}-100)/25)$$

○: $T \geqq 80$

Δ: $80>T \geqq 50$

X: $T<50$

(12) In-Water Insulating Properties:

A sample having an effective length of 2 m in the relaxed state was prepared, and 1 m of the middle portion of the sample was immersed in 10 liters of 1% aqueous NaCl solution (25±2° C.) contained in a 10 liter container (SUS tank), followed by extending both ends above the surface of the solution and fixing in position. After immersing for 20 minutes, one probe of a tester (KAISEI SK-6500) was immersed in the solution and the other probe was connected to one end of the sample followed by measurement of electrical resistance (R). The electrical resistance in the case of having immersed both probes of the tester in salt solution at this time was 60 to 70 KΩ/5 cm.

In-water insulating properties were evaluated according to the following criteria.

○: R>20 MΩ

Δ: 20 MΩ≧R≧10 MΩ

X: R<10 MΩ

Furthermore, the sample was used in this test after having undergone repeated expansion and contraction as described in (10) above for a prescribed number of times by clamping a 20 cm portion of the middle of the sample with chucks 21 and 22.

(13) Short-Circuiting:

An expandable electric cord having a plurality of conductor wires was prepared having a length of 1 m in the relaxed state, and after repeatedly expanding and contracting for a prescribed number of times by clamping a 20 cm portion of the middle of the expandable electric cord with chucks 21 and 22, the end of one of the conductor wires and the end of another conductor wire were connected to both ends of a tester (KAISEI SK-6500), and the expandable electric cord was expanded by 50% followed by measurement of electrical resistance. Short-circuiting was then evaluated according to the following criteria based on that value.

○: R>20 MΩ

Δ: 20 MΩ≧R≧10 MΩ

X: R<10 MΩ

(14) Overall Evaluation:

○: 30% stress load of 1000 cN or less and electrical resistance of 1 Ω/m or less ◎: The above criteria plus particularly superior performance X: Poor processability preventing the obtaining of an expandable electric cord, poor loop form of the expandable electric cord, electrical resistance of 10 Ω/m or more, or 30% stretch load of 5000 cN or more Δ: Parameters other than those indicated above

Examples 1 to 4

220 dt (72 f) wooly nylon (black dyed yarn) (Toray Industries, Inc.) was coiled around a core consisting of 3740 dt (288 f) polyurethane elastic long fiber (Asahi Kasei Fibers Corp. trade name: Roica) using a 500 T/M first twist and 332 T/M final twist at a stretch factor of 4.2 to obtain a double-covered yarn. The resulting double-covered yarn was then used as a core to carry out braiding using a composite thread consisting of two aligned strands of the aforementioned wooly nylon with an 8-braid or 16-braid braiding machine (Kokubun & Co., Ltd.) at a stretch factor of 3.2 to obtain an elastic cylinder having an expandable intermediate layer.

A prescribed copper narrow wire stranded wire (conductor wire) was coiled in the Z direction around the resulting elastic cylinder serving as a core at a stretch factor of 2.6 and feeding speed of 3 m/min using a Kataoka covering machine to obtain an expandable electric cord intermediate.

Next, using the resulting expandable electric cord intermediate for the core, braiding was carried out with a 16-braid braiding machine using the composite thread consisting of the two aligned strands of the aforementioned wooly nylon at a stretch factor of 1.8 to obtain an expandable electric cord of the present invention. The composition, production conditions and results of each evaluation of the resulting expandable electric cords are shown in Table 1.

Furthermore, the rupture ductility of the polyurethane elastic long fiber used was 750% in all cases, including that used in the subsequent examples. In addition, the specific resistance of the copper narrow wire was $0.2\times10^{-5}$ Ω×cm in all cases, including the subsequent examples.

Comparative Example 1

A copper narrow wire stranded wire (conductor wire) was coiled in the same manner as Example 3 with the exception of using 3740 dt (288 f) polyurethane elastic long fiber (Asahi Kasei Fibers Corp., trade name: Roica) for the core and not providing an intermediate layer. However, continuous operation was not possible due to unstable ballooning during coiling. Those results are also shown in Table 1.

Example 5 and Comparative Example 2

167 dt (48 f) ester wooly yarn (black dyed yarn) was braided using an 8-braid braiding machine around a no. 40 round rubber yarn (3224 dt, Ld=0.67 mm) core at a stretch factor of 4 to form an intermediate layer and obtain an elastic cylinder having an expandable intermediate layer.

A copper narrow wire stranded wire (conductor wire) was coiled in the same manner as Example 3 using the resulting elastic cylinder for the core to obtain an expandable electric cord intermediate.

Next, using the resulting expandable electric cord intermediate as a core, braiding was carried out with an 8-braid braiding machine using a composite thread consisting of two aligned strands of 330 dt (72 f) ester wooly yarn (black dyed yarn) at a stretch factor of 1.8 to obtain an expandable electric cord of the present invention. The composition, production conditions and results of each evaluation of the resulting expandable electric cord are also shown in Table 1.

In addition, an expandable electric cord was produced in the same manner as described above with the exception of not forming an intermediate layer to serve as a comparison. However, ballooning was unstable during coiling of the copper narrow wire stranded wire (conductor wire), thereby preventing continuous operation. Those results are also shown in Table 1.

Furthermore, the rupture ductility of the round rubber yarn used was 800%.

Example 6

A prescribed drawn wire was coiled using the SH-7 Coiling Machine (Orii & Mec Corp.) followed by heat-treating by tempering at 270° C. for 20 minutes and then cooling to obtain a prescribed coil spring. Using this coil spring as a core, braiding was carried out using a 440 dt (50 f) fluorine fiber (Toyo Polymer Co., Ltd.) with a braiding machine at a stretch factor of 2.4 to obtain an expandable elastic cylinder.

Using the resulting elastic cylinder as a core, a prescribed copper narrow wire stranded wire (conductor wire) was coiled in the Z direction at a feeding speed of 3 m/min at a stretch factor of 2.2 using a Kataoka covering machine to obtain an expandable electric cord intermediate.

Next, using the resulting expandable electric cord intermediate for the core, braiding was carried out with a 16-braid braiding machine using the composite thread consisting of the two aligned strands of 330 dt (72 f) ester wooly yarn at a stretch factor of 2 to obtain an expandable electric cord of the present invention. The composition, production conditions and results of each evaluation of the resulting expandable electric cord are shown in Table 1.

Furthermore, when the recovery of the coil spring after stretching 150% was investigated, the coil spring completely recovered in all cases, including the subsequent examples, and ductility was 150% or more.

TABLE 1

| | | | Core Portion | | | | | | |
|---|---|---|---|---|---|---|---|---|---|
| | | | Intermediate layer | | | Elastic cylinder | | | |
| | Elastic body | | | | | | | | |
| No. | Composition | Converted diameter Ld (mm) | Provided | Composition | Intermediate layer thickness Lc (mm) | 50% stretch load (cN) | 50% stretching stress (cN/mm$^2$) | Diameter La (mm) | Lc/Ld |
| Ex. 1<br>Ex. 2 | Poly-urethane elastic long fiber 3740 dt/288 f | 0.63 | Yes | Wooly nylon 220 dt/72 f, S/Z covering, 2 strands, 220 dt/72 f, 16 braids | 1.2 | 120 | 17 | 3 | 1.5 |
| Ex. 3<br>Ex. 4 | | | Yes | Wooly nylon 220 dt/72 f, S/Z covering, 2 | 0.8 | 108 | 26 | 2.3 | 0.9 |

TABLE 1-continued

| | | | | | | | | | |
|---|---|---|---|---|---|---|---|---|---|
| | | | | strands, 220 dt/72 f, 8 braids | | | | | |
| Comp. Ex. 1 | | | No | — | — | 91 | 292 | 0.63 | — |
| Ex. 5 | Natural rubber, no. 40 round rubber | 0.67 | Yes | Ester wooly yarn, 1 strand, 167 dt/48 f, 8 braids | 0.16 | 32 | 41 | 1 | 0.15 |
| Comp. Ex. 2 | | | No | — | — | 27 | 77 | 0.67 | — |
| Ex. 6 | Coil spring, stainless steel, drawn wire diameter: 0.2 mm | 1.6 | Yes | Fluorine fiber, 1 strand, 440 dt/50 f, 16 braids | 0.15 | 105 | 30 | 2.1 | 0.09 |

| | Conductor Portion | | | | | | | | | | | | |
|---|---|---|---|---|---|---|---|---|---|---|---|---|---|
| | Conductor wire | | | | | | | | | | | | |
| | Material narrow wire diameter (mm) × no. of narrow wires in conductor wire × | | Coiling angle (°) | | | Sheath | Evaluation | | | | Results | | |
| No. | no. of conductor wire coils | Converted diameter Lm (mm) | Angle during coiling | Relaxed angle | Ld/Lm | Portion Composition | Process-ability | Loop form | 50% stretch recovery | Repetitive expand-ability | Resistance (Ω/m) | 30% stretch load (cN) | 50% stretch load (cN) |
| Ex. 1 | Copper wire (a), 0.03 × 100 × 2 | 0.42 | 45 | 64 | 1.5 | Wooly nylon, 220 dt/72 f, | ○ | ○ | ○ | ○ | 0.28 | 180 | 290 |
| Ex. 2 | Copper wire (c), 0.03 × 90 × 1 | 0.28 | | 66 | 2.3 | two strands, 16 | ○ | ○ | ○ | ○ | 0.66 | 163 | 260 |
| Ex. 3 | Copper wire (a), 0.03 × 100 × 1 | 0.3 | | 64 | 2.1 | braids | ○ | ○ | ○ | ○ | 0.55 | 160 | 250 |
| Ex. 4 | Copper wire (c), 0.03 × 90 × 1 | 0.28 | | 64 | 2.3 | | ○ | ○ | ○ | ○ | 0.62 | 161 | 253 |
| Comp. Ex. 1 | Copper wire (a), | 0.3 | | — | 2.1 | — | X | — | — | — | — | — | — |
| Ex. 5 | 0.03 × 100 × 1 | | | 66 | 2.2 | Ester wooly yarn, 330 dt/72 f, 2 strands, 8 braids | ○ | ○ | ○ | ○ | 0.60 | 40 | 64 |
| Comp. Ex. 2 | | | | — | 2.2 | — | X | — | — | — | — | — | — |
| Ex. 6 | Copper wire (b), 0.03 × 200 × 1 | 0.42 | | 65 | 3.8 | Ester wooly yarn, 330 dt/72 f, 2 strands, 16 braids | ○ | ○ | ○ | ○ | 0.29 | 66 | 110 |

(a) 2UEW, Fuji Fine Co., Ltd.
(b) 2USTC, Fuji Fine Co., Ltd.
(c) 2USTC, Tatsuno Densen Co., Ltd.

In Table 1, since the values of Lm/Ld of Comparative Examples 1 and 2 are 2.1 and 2.2 (which are both less than 3), processability is poor, loop form is poor, and an expandable electric cord was found to be unable to be obtained as described in the known patent publications. However, stable processability was found to be obtained by forming an intermediate layer around an elastic long fiber to obtain an elastic cylinder despite using the same elastic long fiber, thereby making it possible to obtain an expandable electric cord having good expandability. This indicates that an expandable electric cord can be obtained able to expand and contract with low stress and able to carry a large current, which was unable to be achieved in the prior art.

Examples 7 to 9 and Comparative Examples 3 and 4

Expandable electric cords were produced in the same manner as Example 4 with the exception of changing the narrow wire stranded wire (conductor wire). Furthermore, the conductor wire in Comparative Example 4 was unable to be stably coiled. The composition, production conditions and results of each evaluation of the resulting expandable electric cords are shown in Table 2.

Examples 10 and 11

Expandable electric cords were produced in the same manner as Example 4 with the exception of changing the elastic long fiber, copper narrow wire stranded wire (conductor wire) and insulating fiber used for the sheath portion. The composition, production conditions and results of each evaluation of the resulting expandable electric cords are also shown in Table 2.

TABLE 2

| | Core Portion | | | | | | | | |
|---|---|---|---|---|---|---|---|---|---|
| | Elastic body | | Intermediate layer | | | Elastic cylinder | | | |
| No. | Composition | Converted diameter Ld (mm) | Provided | Composition | Intermediate layer thickness Lc (mm) | 50% stretch load (cN) | 50% stretching stress (cN/mm$^2$) | Diameter La (mm) | Lc/Ld |
| Comp. Ex. 3<br>Ex. 4<br>Ex. 7<br>Comp. Ex. 4<br>Ex. 8<br>Ex. 9 | Poly urethane elastic long fiber, 3740 dt/288 f | 0.63 | Yes | Wooly nylon 200 dt/72 f, S/Z covering, wooly nylon, 220 dt/72 f, 2 strands, 8 braids | 0.8 | 108 | 26 | 2.3 | 1.5 |
| Ex. 10<br>Ex. 11 | Poly-urethane elastic long fiber, 7480 dt/575 f | 0.89 | Yes | | 0.8 | 175 | 36 | 2.5 | 0.9 |

| | Conductor Portion | | | | | | | | | | | | |
|---|---|---|---|---|---|---|---|---|---|---|---|---|---|
| | Conductor wire | | | | | | | | | | Results | | |
| No. | Material narrow wire diameter (mm) × no. of narrow wires in conductor wire × no. of conductor wire coils | Converted diameter Lm (mm) | Coiling angle (°) Angle during coiling | Coiling angle (°) Relaxed angle | Ld/Lm | Sheath Portion Composition | Evalution Process-ability | Evalution Loop form | Evalution 50% stretch recovery | Evalution Repetitive expand-ability | Resistance (Ω/m) | 30% stretch load (cN) | 50% stretch load (cN) |
| Comp. Ex. 3 | Copper wire (a) 0.03 × 1 × 1 | 0.03 | 45 | 71 | 21 | Wooly nylon, 220 dt, 2 strands, 16 braids | ○ | ○ | ○ | X | 72 | 151 | 240 |
| Ex. 4 | Copper wire (c) 0.03 × 90 × 1 | 0.28 | | 64 | 2.3 | | ○ | ○ | ○ | ○ | 0.55 | 172 | 250 |
| Ex. 7 | Copper wire (c) 0.3 × 180 × 1 | 0.40 | | 64 | 1.6 | | ○ | ○ | ○ | ○ | 0.31 | 178 | 266 |
| Comp. Ex. 4 | Copper wire (d) 0.3 × 1 × 1 | 0.3 | | — | 2.1 | — | X | — | — | — | — | — | — |

TABLE 2-continued

| | | | | | | | | | | | | | |
|---|---|---|---|---|---|---|---|---|---|---|---|---|---|
| Ex. 8 | Copper wire (c) 0.03 × 90 × 1 | 0.28 | 35 | 57 | 2.3 | Wooly nylon, 220 dt, 2 strands, 16 braids | ○ | ○ | ○ | ○ | 0.50 | 160 | 250 |
| Ex. 9 | | | 60 | 75 | | | ○ | ○ | ○ | ○ | 1.04 | 170 | 270 |
| Ex. 10 | Copper wire (c) 0.03 × 360 × 1 | 0.57 | 45 | 66 | 1.6 | Ester wooly yarn, 330 dt, 2 strands, 16 braids | ○ | ○ | ○ | ○ | 0.22 | 310 | 470 |
| Ex. 11 | Copper wire (c) 0.03 × 720 × 1 | 0.8 | | 63 | 1.0 | | ○ | ○ | ○ | ○ | 0.07 | 360 | 520 |

(a) 2UEW, Fuji Fine Co., Ltd.
(c) 2USTC, Tatsuno Densen Co., Ltd.
(d) Commercially available enamel wire In looking at Comparative Example 3 in Table 2, although the conductor wire was coiled in the form of a single wire, electrical resistance can be seen to increase considerably resulting in a lack of practicality. A comparison of Example 7 and Comparative Example 4 reveals that as a result of using the conductor wire in the form of a stranded wire of narrow wires, a substantially thick conductor wire can be coiled on the elastic cylinder. In Example 11, the expandable electric cord can be seen to be able to be stretched at a small load, electrical resistance can be reduced and the electric cord is able to carry a large current. Namely, as a result of using an elastic cylinder having an intermediate layer for the core portion and coiling conductive narrow stranded wires for the conductor wire, it can be understood that a large current can be carried while enabling expansion and contraction with low stress.

Examples 12 and 13

Expandable electric cords were produced in the same manner as Example 6 with the exception of changing the copper narrow wire stranded wire (conductor wire). The composition, production conditions and results of each evaluation of the resulting expandable electric cords are shown in Table 3.

Example 14

An expandable electric cord was produced in the same manner as Example 6 with the exception of changing the coil spring, insulating fiber comprising the intermediate layer, copper narrow wire stranded wire (conductor wire) and number thereof, and the insulating fiber used for the sheath portion. The composition, production conditions and results of each evaluation of the resulting expandable electric cord are also shown in Table 3.

Furthermore, measurement of electrical resistance and the value of heat-generating current were carried out by gathering and connecting the conductor wires into a single wire.

TABLE 3

| | Core Portion | | | | | | | | |
|---|---|---|---|---|---|---|---|---|---|
| | Elastic body | | Intermediate layer | | | Elastic cylinder | | | |
| No. | Composition | Converted diameter Ld (mm) | Provided | Composition | Intermediate layer thickness Lc (mm) | 50% stretch load (cN) | 50% stretching stress (cN/mm$^2$) | Diameter La (mm) | Lc/Ld |
| Ex. 12 | Coil spring material: Stainless steel, drawn wire diameter: 0.2 mm | 1.6 | Yes | Fluorine fiber, 440 dt/50 f, single strand, 16 braids | 0.15 | 105 | 30 | 2.1 | 0.09 |
| Ex. 13 | | | | | | | | | |
| Ex. 14 | Coil spring material: stainless steel, drawn wire diameter: 0.3 mm | 2.4 | | Fluorine fiber, 440 dt/50 f, 2 strands, 16 braids | 0.2 | 160 | 26 | 2.8 | 0.08 |

TABLE 3-continued

| No. | Conductor Portion: Conductor wire: Material narrow wire diameter (mm) × no. of narrow wires in conductor wire × no. of conductor wire coils | Converted diameter Lm (mm) | Coiling angle (°): Angle during coiling | Coiling angle (°): Relaxed angle | Ld/Lm | Sheath Portion Composition | Evaluation: Process-ability | Loop form | 50% stretch recovery | Repetitive expand-ability |
|---|---|---|---|---|---|---|---|---|---|---|
| Ex. 12 | Copper wire (b) 0.03 × 180 × 1 | 0.4 | 45 | 68 | 4 | Ester wooly yarn, 330 dt/72 f, 2 strands, 16 braids | ○ | ○ | ○ | ○ |
| Ex. 13 | Copper wire (c) 0.03 × 540 × 1 | | | | 2.3 | | ○ | ○ | ○ | ○ |
| Ex. 14 | Copper wire(c) 0.05 × 540 × 2 | 2.4 | | 69 | 1.5 | Ester wooly yarn, 330 dt/72 f, 3 strands, 16 braids | ○ | ○ | ○ | ○ |

| No. | Results: 30% stretch load (cN) | 50% stretch load (cN) | 50% stretch recovery (%) | Resistance (Ω/m) | Heat-generating current value (A) |
|---|---|---|---|---|---|
| Ex. 12 | 66 | 110 | 97 | 0.36 | 3 |
| Ex. 13 | 69 | 115 | 97 | 0.13 | 11 |
| Ex. 14 | 108 | 180 | 98 | 0.02 | 27 |

(b) 2USTC, Fuji Fine Co., Ltd.
(c) 2USTC, Tatsuno Densen Co., Ltd.

The expandable electric cord of the present invention was determined to be able to carry a large current of several to several tens of amperes while able to expand at low stress based on heat-generating current values.

The results of evaluation heat resistance using the expandable electric cords obtained in Examples 12 and 7 are shown in Table 4. Example 12 was determined to be an expandable electric cord able to be used under particularly harsh conditions.

TABLE 4

| | Core Portion: Composition | Elastic cylinder 50% stretching stress (cN/mm$^2$) | Conductor Portion: Material, narrow wire diameter (mm) × no. of narrow wires in conductor wire × no. of conductor wire coils | Coiling angle when relaxed (°) | Sheath Portion: Composition | Outer diameter after covering (mm) | Results: Resistance (Ω/m) | 50% stretch load (cN) | Heat resistance: Length after heat-treatment (mm) | Recovery rate after heat treatment (%) | Evaluation |
|---|---|---|---|---|---|---|---|---|---|---|---|
| Ex. 12 | Coil spring + fluorine fiber | 30 | Copper wire (c) 0.03 × 180 × 1 | 65 | Ester wooly yarn, 330 dt/72 f, 2 strands, 16 braids | 3.4 | 0.33 | 110 | 100 | 100 | ○ |
| Ex. 7 | Polyurethane elastic long fiber + wooly nylon | 24 | | 64 | Wooly nylon, 220 dt/72 f, 2 strands, 16 braids | 2.8 | 0.31 | 266 | 112 | 52 | Δ |

(c) 2USTC, Tatsuno Densen Co., Ltd.

Examples 15 and 16

Expandable electric cords were produced in the same manner as Example 4 with the exception of using coiling a plurality of conductor wires. Furthermore, a prescribed number of conductor wires were preliminarily wrapped around a bobbin when coiling the plurality of conductor wires, followed by coiling with a covering machine. The composition, production conditions and results of each evaluation of the resulting expandable electric cord are shown in Table 5 along with the results for Example 4.

Example 17

An expandable electric cord was produced in the same manner as Example 7 with the exception of coiling a plurality of conductor wires. Furthermore, a prescribed number of conductor wires were preliminarily wrapped around a bobbin when coiling the plurality of conductor wires, followed by coiling with a covering machine. The composition, production conditions and results of each evaluation of the resulting expandable electric cord are also shown in Table 5 along with the results for Example 7. It can be determined from Table 5 that a satisfactory expandable electric cord is obtained even when using a plurality of conductor wires.

TABLE 5

| | Core Portion | | | | | | | | |
|---|---|---|---|---|---|---|---|---|---|
| | Elastic body | | Intermediate layer | | | Elastic cylinder | | | |
| No. | Composition | Converted diameter Ld (mm) | Provided | Composition | Intermediate layer thickness Lc (mm) | 50% stretch load (cN) | 50% stretching stress (cN/mm$^2$) | Diameter La (mm) | Lc/Ld |
| Ex. 4<br>Ex. 15<br>Ex. 16<br>Ex. 7<br>Ex. 17 | Poly-urethane elastic long fiber, 3740 dt/288 f | 0.03 | Yes | Wooly nylon, 220 dt/72 f, S/Z covering, Wooly nylon, 220 dt/72 f, 2 strands, 16 braids | 0.8 | 108 | 26 | 2.3 | 0.9 |

| | Conductor Portion | | | | | | | | | | | | |
|---|---|---|---|---|---|---|---|---|---|---|---|---|---|
| | Conductor wire | | | | | | | | | | Results | | |
| No. | Material narrow wire diameter (mm) × no. of narrow wires in conductor wire × no. of conductor wire coils | Converted diameter Lm (mm) per conductor wire Lm (mm) | Coiling angle (°) Angle during coiling | Coiling angle (°) Relaxed angle | Ld/Lm | Sheath Portion Composition | Evaluation Process-ability | Evaluation Loop form | Evaluation 50% stretch recovery | Evaluation Repetitive expand-ability | Resistance per conductor wire (Ω/m) | 30% stretch load (cN) | 50% stretch load (cN) |
| Ex. 4 | Copper wire (c) 0.03 × 90 × 1 | 0.28 | 45 | 64 | 2.3 | Wooly nylon, 220 dt/72 f, 2 strands, 16 braids | ○ | ○ | ○ | ○ | 0.62 | 161 | 263 |
| Ex. 15 | Copper wire(c) 0.03 × 90 × 2 | | | 63 | | | ○ | ○ | ○ | ○ | 0.59 | 176 | 268 |
| Ex. 16 | Copper wire (c) 0.3 × 90 × 4 | | | 62 | | | ○ | ○ | ○ | ○ | 0.58 | 182 | 274 |
| Ex. 7 | Copper wire (c) 0.3 × 180 × 1 | 0.4 | | 64 | 1.6 | | ○ | ○ | ○ | ○ | 0.31 | 178 | 266 |
| Ex. 17 | Copper wire (c) 0.03 × 180 × 4 | | | 62 | | | ○ | ○ | ○ | ○ | 0.29 | 188 | 292 |

(c) 2USTC, Tatsuno Densen Co., Ltd.

Example 18

An elastic cylinder produced in the same manner as Example 1 was braided at a stretch factor 2.2 by alternately arranging four conductor wires (2USTC, 30 μm×90, Tatsuno Densen Co., Ltd.) and 4 wooly nylon strands (220 dt (72 f)×3 aligned strands) in the Z direction, and braiding four ester wooly strands (155 dt (36 f)) in the S direction with a 16-braid braiding machine to obtain an expandable electric cord intermediate. The resulting expandable electric cord intermediate was externally covered in the same manner as Example 1 at a stretch factor of 1.8 with a 16-braid braiding machine to obtain an expandable electric cord having four conductor wires.

A 1 m sample of this expandable electric cord was obtained in the relaxed state and the transmission loss of the two internal adjacent conductor wires of the four conductor wires was investigated using a network analyzer (Hewlett-Packard 8703A). The transmission loss at 250 Mhz was −6 db, thereby demonstrating that the expandable electric cord can be used for high-speed transmission. As a result of similarly measuring the expandable electric cord obtained in Example 16, the transmission loss was found to be −12 db.

In addition, although the expandable electric cord obtained in Example 16 short-circuited after being repeatedly expanded and contracted 100,000 times as a result of evaluating for short-circuiting, the expandable electric cord obtained in this example did not short-circuit even when repeatedly expanded and contracted 1,000,000 times.

In this manner, an expandable electric cord employing a braided structure in which a plurality of conductor wires arranged in a single direction while an insulating fiber is arranged in the opposite direction was determined to demonstrate superior transmission characteristics as well as superior resistance to short-circuiting following repeated expansion and contraction.

Example 19

An expandable electric cord intermediate was obtained in the same manner as Example 15. The resulting expandable electric cord intermediate was immersed in a low-hardness urethane gel (Landsorber UE04 #052601 (base resin) and Landsorber UE04 #052602 (curing agent) manufactured by Unimac Co., Inc. mixed at a ratio of 100:35) followed by removal of liquid with a tension bar and heat treating for 60 minutes at 80° C. to integrate the elastic cylinder and conductor wire. External covering was carried out in the same manner as Example 15 using the resulting integrated product to obtain an expandable electric cord of the present invention. The composition, production conditions and results of each evaluation of the resulting expandable electric cord are shown in Table 6 along with the results for Example 15.

TABLE 6

| | Core Portion | | | | | | | | |
|---|---|---|---|---|---|---|---|---|---|
| | Elastic body | | Intermediate layer | | | Elastic cylinder | | | |
| No. | Composition | Converted diameter Ld (mm) | Provided | Composition | Intermediate layer thickness Lc (mm) | 50% stretch load (cN) | 50% stretching stress (cN/mm$^2$) | Diameter La (mm) | Lc/Ld |
| Ex. 15<br>Ex. 19 | Poly-urethane elastic long fiber 3740 dt/288 f | 0.63 | Yes | Wooly nylon, 220 dt/72 f, S/Z covering, Wooly nylon, 220 dt, 2 strands, 8 braids | 0.8 | 108 | 26 | 2.3 | 0.9 |

| | Conductor Portion | | | | | | | | | |
|---|---|---|---|---|---|---|---|---|---|---|
| | Conductor wire | | | | | | | | Evaluation | |
| No. | Material narrow wire diameter (mm) × no. of narrow wires in conductor wire × no. of conductor wire coils | Converted diameter per conductor wire Lm (mm) | Coiling angle (°) Angle during coiling | Coiling angle (°) Relaxed angle | Ld/Lm | Integration Integrated layer Provided | Integration Integrated layer Composition | Sheath Portion Composition | 50% stretch recovery (%) | Repetitive expand-ability |
| Ex. 15 | Copper wire(c) 0.03 × 180 × 2 | 0.28 | 45 | 67 | 2.3 | No | — | Wooly nylon, 220 dt, 2 strands, 16 braids | ○ | ○ |
| Ex. 19 | | | | | | Yes | Poly-urethane gel | | ○ | ○ |

TABLE 6-continued

| | Results | | | | | | |
|---|---|---|---|---|---|---|---|
| | | | | Short-circuiting | | In-water insulating properties | |
| No. | Resistance per conductor wire (Ω/m) | 30% stretch load (cN) | 50% stretch load (cN) | Before repeated expansion and contraction | After repeatedly expanding and contracting 10,000 times | Before repeated expansion and contraction | After repeatedly expanding and contracting 10,000 times |
| Ex. 15 | 0.35 | 176 | 268 | ○ | Δ | ○ | Δ |
| Ex. 19 | 0.35 | 320 | 430 | ○ | ○ | ○ | ○ |

(c) 2USTC, Ryuno Densen Co., Ltd.

Integration treatment was determined to reduce the risk of short-circuiting in a structure having a plurality of conductor wires. In addition, this also improved in-water insulating properties.

INDUSTRIAL APPLICABILITY

The expandable electric cord of the present invention is optimal for wiring portions having bent sections such as curved extensions and the like in various fields including robotics. As a result of using a suitable elastic body, forming an intermediate layer with a suitable insulating fiber, having a conductor wire of a desired converted diameter, carrying out integration treatment as necessary, and covering with a suitable insulating fiber, an expandable electric cord can be obtained that is optimal for applications requiring shape deformation following properties such as prosthetic wiring, wearable device wiring and articulated robot (ranging from household to industrial applications) wiring.

In addition, this expandable electric cord can be used under usage conditions at high temperatures.

The invention claimed is:

1. An expandable electric cord having a structure at least comprised of a core portion, a conductor portion and a sheath portion; wherein, the core portion is an elastic cylinder comprised of an elastic body and an intermediate layer covering the outer periphery thereof, the elastic body is an elastic long fiber having ductility of 100% or more and a converted diameter of 0.01 to 10 mm, or a coil spring having ductility of 50% or more and an outer diameter of 0.02 to 30 mm, the thickness of the intermediate layer is within the range of 0.1 Ld (Ld: converted diameter of the elastic long fiber or outer diameter of the coil spring) or 0.1 mm, whichever is smaller, to 10 mm, the conductor portion contains a conductor wire comprised of narrow stranded wires, with the conductor wire being coiled and/or braided around the outer periphery of the elastic cylinder, and the sheath portion is an outer sheath layer comprised of an insulator that covers the outer periphery of the conductor portion, and the 30% stretch load is 5000 cN or less.

2. The expandable electric cord according to claim 1, wherein the 50% stretching stress of the elastic cylinder is 1 to 500 cN/mm$^2$.

3. The expandable electric cord according to claim 1, wherein the conductor wire is comprised of an electrical conductor having specific resistance of $10^{-4}$ Ω×cm or less.

4. The expandable electric cord according to claim 1, wherein the diameter of the narrow wire (Lt) is 1 mm or less.

5. The expandable electric cord according to claim 1, wherein the conductor wire contains 80% or more of copper or aluminum.

6. The expandable electric cord according to claim 1, wherein the conductor wire has an insulating sheath layer having a thickness of 1 mm or less for each narrow wire, or has an insulating sheath layer having a thickness of 2 mm or less for all of the stranded wires.

7. The expandable electric cord according to claim 1, wherein the conductor wire has an integration layer for integrating into the core section, and the integration layer is comprised of an elastic body having ductility of 50% or more.

8. The expandable electric cord according to claim 1, wherein the conductor portion is comprised of a plurality of conductor wires.

9. The expandable electric cord according to claim 1, wherein the electrical resistance of a single conductor wire is 10 Ω/m or less.

10. An expandable electric cord in the form of a narrow width, elastic tape, wherein a plurality of the expandable electric cords according to claim 1 are gathered into the form of a single narrow width, elastic tape while stretching.

* * * * *